US005351390A

United States Patent [19]

Yamada et al.

[11] Patent Number: 5,351,390

[45] Date of Patent: Oct. 4, 1994

[54] MANUFACTURING METHOD FOR A PTC THERMISTOR

[75] Inventors: Makoto Yamada, Tokyo; Setsuya Isshiki, Funabashi; Yukihiko Kurosawa; Masakazu Kuroda, both of Chiba; Morio Hayashi, Kasukabe, all of Japan

[73] Assignee: Fujikura Ltd., Tokyo, Japan

[21] Appl. No.: 3,473

[22] Filed: Jan. 12, 1993

Related U.S. Application Data

[62] Division of Ser. No. 524,920, May 18, 1990, Pat. No. 5,212,466.

[30] Foreign Application Priority Data

May 18, 1989 [JP] Japan ..... 1-125516
Jun. 6, 1989 [JP] Japan ..... 1-43916
Apr. 3, 1990 [JP] Japan ..... 2-88462

[51] Int. Cl.[5] ..... H01C 7/02; H01C 17/28

[52] U.S. Cl. ..... 29/612; 29/621; 29/411; 29/854

[58] Field of Search ..... 29/612, 621, 854, 411, 29/25.35

[56] References Cited

U.S. PATENT DOCUMENTS 2,864,013 12/1958 Wood ..... 29/25.35
3,086,281 4/1963 Shockley et al. ..... 29/854
3,221,145 11/1965 Hager, Jr. .
4,272,471 6/1981 Walker .
4,327,351 4/1982 Walker .
4,331,861 5/1982 Meixner .
4,445,026 4/1984 Walker .
4,786,888 11/1988 Yoneda et al. .
4,901,186 2/1990 Tennant et al. .
4,937,551 6/1990 Plasko .
4,954,696 9/1990 Ishii et al. .

FOREIGN PATENT DOCUMENTS 1577156 8/1956 Australia .
45173 8/1979 Australia .
0026456 4/1981 European Pat. Off. .
010843 3/1984 European Pat. Off. .
3707505 9/1987 Fed. Rep. of Germany .

*Primary Examiner*—P. W. Echols
*Attorney, Agent, or Firm*—Cushman, Darby & Cushman

[57] ABSTRACT

PTC (positive temperature coefficient) thermistors of a novel configuration and a method for their manufacture. The PTC thermistors have a PTC element sandwiched between two electrodes for which leads are formed as an extension of each of the two electrodes protruding beyond the edge of the PTC element. Several manufacturing methods avoid undue thermal and physical stress to the PTC composition while providing PTC thermistors having a variety of shapes and configurations.

10 Claims, 8 Drawing Sheets

MANUFACTURING METHOD FOR A PTC THERMISTOR

This is a division of application Ser. No. 07 /524,920, filed MAY 18, 1990 now U.S. Pat. No. 5,212,466.

BACKGROUND OF THE INVENTION

1. Field of the Invention

The present invention relates to PTC (positive temperature coefficient) thermistors, and their manufacturing methods.

2. Prior Art

PTC (positive temperature coefficient) thermistors are well known devices which have been employed in electronic circuits for over current protection and for thermal sensing. A conventional PTC thermistor is shown in FIG. 17. As can be seen in the illustration, the PTC thermistor SO has a composite structure of sandwiched PTC composition 1*a* between electrodes 2*a* and 3*a*. The above mentioned PTC element 1*a* is comprised of a PTC composition including polymers and conductive particles which demonstrates positive thermal coefficient resistance properties. The electrodes 2*a*, 3*a* are formed from sheet form metallic material, and each is provided with a respective lead 4, 5 connected thereto as shown in FIG. 17.

For the manufacture of this type of PTC thermistor SO, the following method, for instance, can be applied. First of all, as is shown in FIG. 18, two relatively large metallic sheets 2, 3 each of which constitutes a plurality of the individual thermistor electrodes 2*a*, 3*a* respectively, are bonded to the opposing upper and lower surfaces of a sheet of PTC composition 1 which is to constitute a plurality of the individual PTC elements 1*a*, thereby forming a laminated PTC thermistor sheet 6. The above bonding of the metallic sheets 2, 3 to the PTC composition 1 is conventionally achieved using a conductive adhesive agent. Next, as shown in FIG. 19, the PTC thermistor sheet 6 thus fabricated is cut into small thermistor chips 7 of the desired form. Finally, to the both the upper and lower electrode 2*a*, 3*a* of each thermistor chip, a respective lead 4, 5 is soldered or spot welded, thereby establishing an electrical connection between lead wire 4, 5 and the electrodes 2*a*, 3*a*, whereby the PTC thermistor SO shown in FIG. 17 is fabricated.

With the type of PTC thermistor SO shown in FIG. 17 and for the fabrication method thus described, several problems exist. These problems include the following:

1. It is necessary to prepare the leads 4, 5 from a separate metal sheet or metal wire from that used for the electrodes 2*a*, 3*a*.
2. A manufacturing process of connecting the leads 4, 5 to the electrodes 2*a*, 3*a* is necessary.
3. Application of heat and pressure to the thermistor chips 7 occurs when the leads 4, 5 are connected by soldering or spot welding. In particular, there is always the possibility that the added heat will deleteriously effect the PTC composition, for example resulting in change in the resistance properties of the composition, deterioration of the composition, weakening of the bond with the electrodes, etc.
4. Variability in the quality of the electrical and physical connection between the leads 4, 5 and the electrodes 2*a*, 3*a* is likely to occur which also impairs the performance of the finished thermistor.

SUMMARY OF THE INVENTION

In consideration of the above, it is an object of the present invention to provide PTC thermistors having simplified physical structures for which the electrical properties are consistent and can be selected to meet design requirements. A second object is to provide manufacturing methods for such PTC thermistors.

In order to achieve the above described first object of the present invention, a PTC thermistor is disclosed having a PTC element sandwiched between two plates for which lead portions are formed as an extension of each of the two plates protruding beyond the edge of the PTC element.

In order to achieve the above described second object of the present invention, starting with a sheet form PTC composition which demonstrates a positive thermal coefficient, the PTC composition is sandwiched between and caused to adhere to two metal sheets, the metal sheets having a surface area which is greater than the surface area of the opposing surfaces of the sheet of PTC composition with which they are in contact.

As an additional means to achieve the above described second object of the present invention, starting with a sheet form PTC composition which demonstrates a positive thermal coefficient, the PTC composition is sandwiched between and caused to adhere to two metal sheets, a first metal sheet and a second metal sheet. The PTC thermistor sheet thus formed is then sectioned into a plurality of PTC thermistor chips, each shaped so as to have at least two tongue-like projections which will subsequently be formed into leads. Next, for each PTC thermistor chip thus fabricated, from at least one of the tongue-like projections, the PTC composition and the overlying metal sheet from the first metal sheet is removed. Additionally, for each PTC thermistor chip, the PTC composition and the overlying metal sheet from the second metal sheet is removed from at least one of the remaining tongue-like projections.

For the PTC thermistor of the first object as described above, as well as for the PTC thermistors fabricated by the two methods described above in connection with the second object of the present invention, both electrodes of the PTC thermistor which are formed from corresponding metal sheets (or other suitable materials) have extensions integrally formed therein which function as electrical leads. Accordingly, it is possible to eliminate the need for separately prepared and attached electrical leads connected with the electrodes, and the above described problems associated therewith.

DETAILED DESCRIPTION OF THE PREFERRED EMBODIMENTS

In the following sections, preferred embodiments of PTC thermistors and manufacturing methods for PTC thermistors will be described in detail with reference to the drawings. First of all, a first preferred embodiment will be described with reference to FIG. 1.

First Preferred Embodiment

Figure 1:
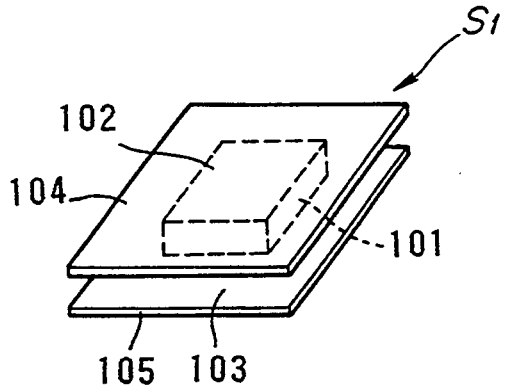
FIG. 1 is a schematic structural drawing illustrating an example of a PTC thermistor in accordance with a first embodiment of the present invention.

In FIG. 1, a schematic structural drawing illustrating an example of a PTC thermistor S1 in accordance with the first preferred embodiment is shown. As can be seen in the drawing, the PTC thermistor S1 is made up of a block of PTC composition 101 which demonstrates positive thermal coefficient properties, sandwiched between two electrodes 102, 103. The block of PTC composition 101 is formed so as to have two opposing surfaces which have an equal and substantially greater surface area than that of any of the other surfaces of the block of PTC composition 101. These two surfaces having the greatest surface area are the surfaces which contact the electrodes 102, 103.

Figure 17:
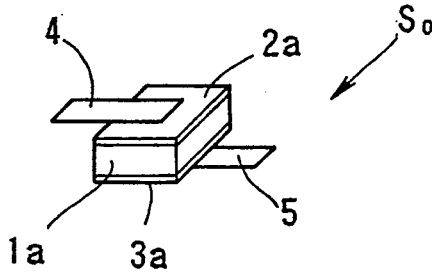
FIG.17 (PRIOR ART)
FIG. 17 is a schematic structural drawing illustrating an example of a conventional PTC thermistor.
Figure 18:
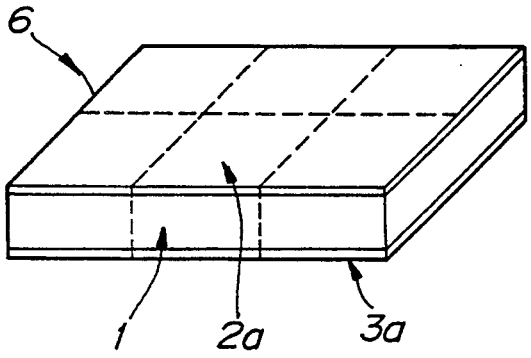
FIG.18 (PRIOR ART)
FIGS. 18 and 19 are oblique views showing steps of a conventional manufacturing method for PTC thermistors.
Figure 19:
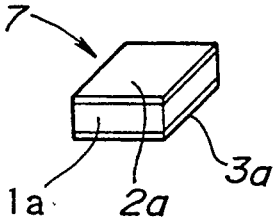
FIG.19 (PRIOR ART)

The PTC thermistor S1 shown in FIG. 1 differs from the conventional PTC thermistor SO shown in FIG. 17 in that, for the PTC thermistor S1 shown in FIG. 1, the surface area of one side of each of the electrodes is greater than the surface area of the surface of the block of PTC composition 101 with which it is in contact. Thus, a portion of each electrode 102, 103 extends beyond the edges of the block of PTC composition 101, the extending portion of each electrode thereby forming a respective lead portion 104, 105.

As mentioned above, the block of PTC composition 101 is formed from a PTC composition which demonstrates positive thermal coefficient properties. This PTC composition may be an organic substance. As an example, the PTC composition may be formed from a resin composite material including a resin matrix in which carbon black or some similar substance which is an electrical conductor is dispersed.

The electrodes 102, 103 of the present invention as well as the leads portions 104, 105 formed thereof are fabricated from a metal which is a good electrical conductor, for example, nickel or copper sheet material. Additionally, the electrodes 102, 103 and leads 104, 105 may be fabricated from a thin layer of highly conductive metal leaf applied to a base plate formed from an insulating material. Other examples include grid electrode material, mesh electrode material, or braided electrode material. Furthermore, suitably conductive nonmetallic materials may be applied as well.

For purposes of the present invention, the term "contact portion" of the electrode means the portion of the electrode 102, 103, a substantial portion of which is in contact with the block of PTC composition and the term "lead portion" means a portion of the electrode which is free from contact with the block of PTC composition. Typically, the lead portion of the electrode extends beyond the periphery of the block of PTC composition with which the electrode is in contact.

For purposes of the present invention, the term "single continuous electrode having a lead portion integrally formed with a contact portion" means an electrode such as illustrated in FIG. 1 (as well as in other embodiments of the present invention) wherein the electrode is formed from a sheet comprising a contact portion and at least one extension integrally formed therewith which functions as a lead portion. Thus, the single continuous electrode having a lead portion integrally formed with a contact portion can be formed without the need for a separately prepared and attached electrical lead connected to a contact portion as is necessary for the conventional PTC thermistor described in conjunction with FIG. 17. For purposes herein, the lead portions 4, 5 of the conventional thermistor of FIG. 17 are not deemed "integrally formed" with the electrodes 2*a*, 3*a* since they are formed from separately prepared and attached conductive materials.

The lead portions of the devices of the present invention provide that that the devices can be connected to wires or other components of electrical systems using known techniques such as solder, conductive adhesives, mechanical means, or other techniques without encountering the problems associated with the prior art devices.

Second Preferred Embodiment

Figure 2:
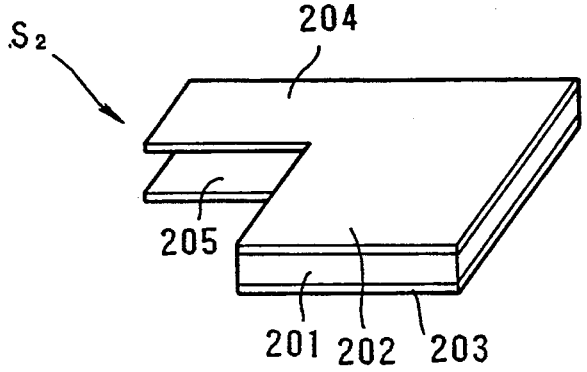
FIG. 2 is a schematic structural drawing illustrating an example of a PTC thermistor in accordance with a second embodiment of the present invention.

In FIG. 2, a schematic structural drawing illustrating an example of a PTC thermistor S2 in accordance with this second embodiment is shown. The PTC thermistor S2 shown in FIG. 2, differs from the PTC thermistor S1 of the first embodiment shown in FIG. 1 in that, for the PTC thermistor S2, only a portion of each of the electrodes 202, 203 extends beyond the edges of the block of PTC composition 201, thereby forming leads or lead portions 204, 205 as tongue-like projections, each extending from an edge of its respective electrode 202, 203. As will be explained below in the description of manufacturing methods, by forming the electrodes 202, 203 with the above mentioned tongue-like projections, the manufacturing steps can be considerably simplified. Furthermore, with this kind of structure, connecting the PTC thermistor S2 with other components within an electrical circuit is much simplified.

Both the contact portions of the electrodes 202, 203 and the lead portions 204, 205 have been shown in FIG. 2 as having a square or rectangular shape. The present embodiment is not so limited, however, and both the contact portions of the electrodes 202, 203 and the leads 204, 205 can be of any desired outline. The contact portions of the electrodes 202, 203, for example may be semicircular in shape with their respective lead portions 204, 205 extending from the flat side of the semicircle outline.

Third preferred Embodiment

Figure 3:
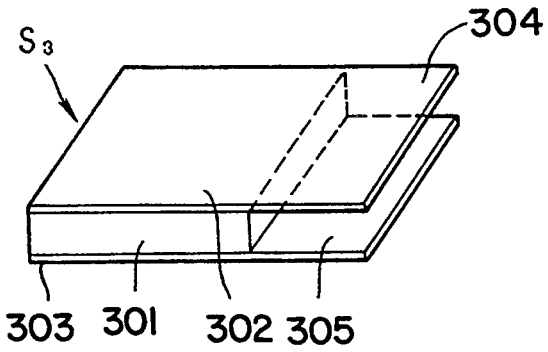
FIG. 3 is a schematic structural drawing illustrating an example of a PTC thermistor in accordance with a third embodiment of the present invention.

In FIG. 3, a schematic structural drawing illustrating a PTC thermistor S3 in accordance with a third embodiment is shown. The PTC thermistor S3 shown in FIG. 3, differs from the PTC thermistor S2 of the second embodiment shown in FIG. 2 in that, for the PTC thermistor S3, the portion of each of the electrodes 302, 303 extending beyond the block of PTC composition 301, thereby forming the lead portions 304, 305, is considerably wider than the lead portions 204, 205 of the PTC thermistor S2, so that the lead portions 304, 305 are the same width as the side of the respective electrodes 302, 303 from which they project.

Fourth Preferred Embodiment

Figure 4:
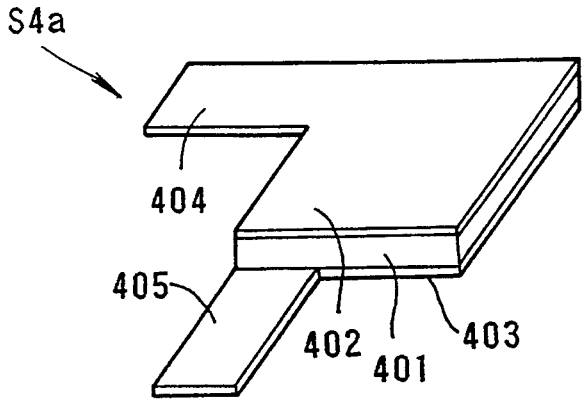
FIGS. 4 and 5 are schematic structural drawings illustrating different examples of a PTC thermistor in accordance with a fourth embodiment of the present invention.
Figure 5:
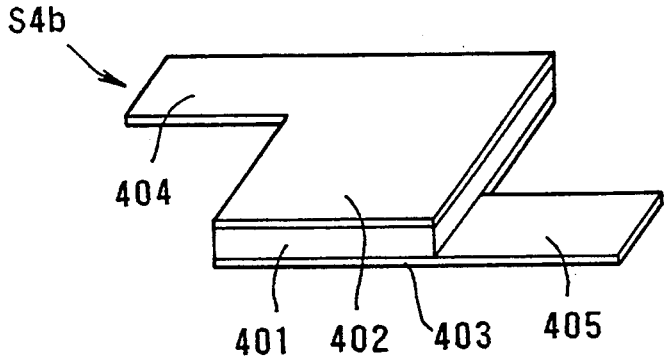

In FIGS. 4 and 5, schematic structural drawings illustrating two examples of a PTC thermistor S4, PTC thermistor S4*a* and PTC thermistor S4*b*, in accordance with this fourth embodiment are shown. The PTC thermistors S4*a*, S4*b* shown in FIGS. 4 and 5 respectively, differ from the PTC thermistor S2 of the second embodiment shown in FIG. 2 in that., for the PTC thermistor S4*a* shown in FIG. 4, the lead portions 404, 405 extend from adjacent sides of the PTC thermistor S4*a* from the contact portions of their respective electrodes 402, 403, and are thus perpendicular to each other. In the case of the PTC thermistor S4*b* shown in FIG. 5, the lead portions 404, 405 extend from opposing sides of the PTC thermistor S4*a* from the contact portions of their respective electrodes 402, 403, and are thus parallel. With a structure in which the leads project from different sides of the PTC thermistor, as is the case with the PTC thermistors S4*a* and S4*b* of the present embodiment, connecting the PTC thermistors S4*a* and S4*b* with other components within an electrical circuit is even further simplified compared with the PTC thermistors described for the preceding embodiments.

Fifth Preferred Embodiment

Figure 6:
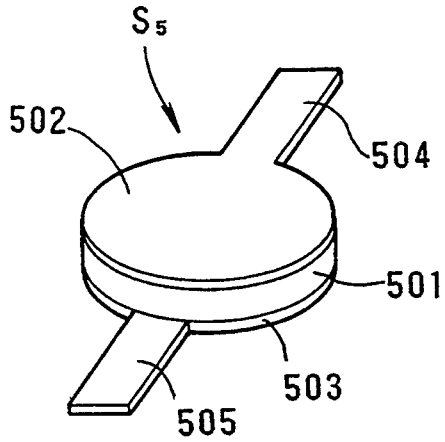
FIG. 6 is a schematic structural drawing illustrating an example of a PTC thermistor in accordance with a fifth embodiment of the present invention.

In FIG. 6, a schematic structural drawing illustrating a PTC thermistor S5 in accordance with a fifth embodiment is shown. The PTC thermistor S5 shown in FIG. 6, differs from the PTC thermistor S4*b* shown in FIG. 5 in that, for the PTC thermistor S5, the block of PTC composition 501 as well as the contact portion of electrodes 502, 503 are circular shaped. By fabricating a PTC thermistor S5 in which the block of PTC composition 501 and the contact portion of electrodes 502, 503 are circular or ellipse shaped, it becomes possible to pack the PTC thermistor S5 and surrounding components in an electrical circuit more densely, and thus facilitates practical applications of the device where a compact design is desirable.

Sixth Preferred Embodiment

Figure 7:
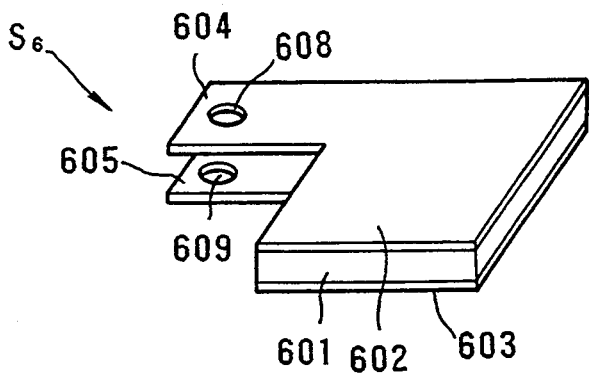
FIGS. 7 through 9 are schematic structural drawings illustrating examples of a PTC thermistor in accordance with a sixth embodiment of the present invention.
Figure 8:
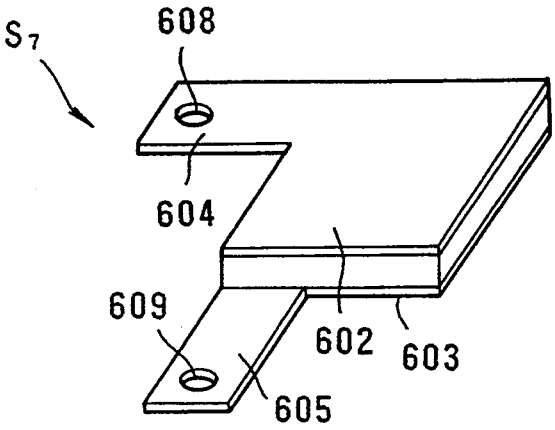
Figure 9:
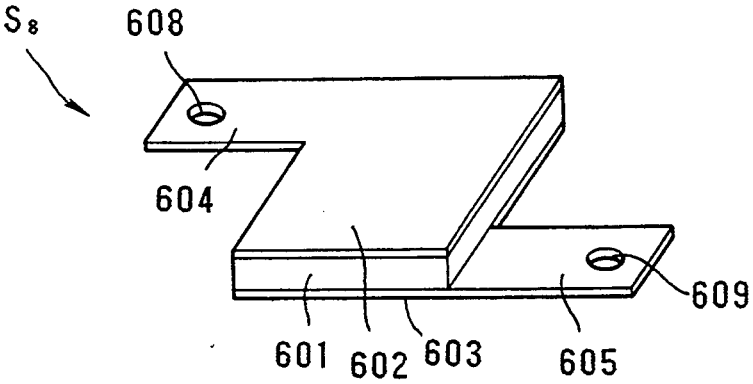

In FIGS. 7 to 9, schematic structural drawings illustrating a PTC thermistor S6, S7, and S8 in accordance with a sixth embodiment of the present invention are shown. The PTC thermistors S6, S7, and S8 of the sixth embodiment are based on PTC thermistor S2 of the second embodiment, and PTC thermistors S4*a* and S4*b* of the fourth embodiment respectively. In each case, circular connection holes 608, 609 are provided in the distal portion of each tongue-like projecting lead portion 604, 605 of each PTC thermistor. The connection holes 608, 609 are provided to facilitate connections with wires and other components in an electrical circuit, using solder, screws, rivets, etc.

Seventh Preferred Embodiment

In the following section, a manufacturing method will be described according to a seventh preferred embodiment, by which the PTC thermistors of any of the preceding six preferred embodiments can be fabricated.

Figure 10:
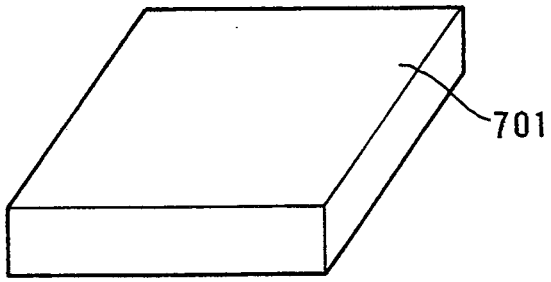
FIG. 10 is an oblique view showing one example of a PTC composition component which can suitably be used in a manufacturing method according to a seventh embodiment of the present invention.

In FIG. 10, an oblique view showing one example of a block of PTC composition 701 which can suitably be used in the manufacturing method according to this seventh embodiment of the present invention is shown. The above mentioned block of PTC composition 701 is fabricated from PTC composition exhibiting positive temperature coefficient properties. The block of PTC composition 701 is formed so as to have two opposing surfaces which have an equal and substantially greater surface area than that of any of the other surfaces of the block of PTC composition 701. This block of PTC composition 701 is sandwiched between two electrodes 702, 703 so that each electrode 702, 703 is in contact with one of the two surfaces of the block of PTC composition 701 having the greatest surface area. It should be noted that to alter certain electrical and/or physical characteristics in accordance with the present invention, the electrodes can alternately be placed in contact with surfaces of the PTC composition other than those having the greatest surface area. By using electrodes 702, 703 which have a larger footprint than does the surface of the block of PTC composition 701 which they contact, it is possible to manufacture any of the PTC thermistors of the first six preferred embodiments by using an appropriately shaped block of PTC composition 701 and appropriately shaped electrodes 702, 703.

According to this method of the seventh embodiment, first of all, a block of PTC composition 701 is formed so as to have the desired size and shape. As a means to form the block of PTC composition 701, nearly any method is suitable provided that it does not heat the PTC composition in such a way that its resistance and other physical characteristics are degraded. In the case where the block of PTC composition 701 is formed of a composite resin composition, extrusion molding and such conventional methods are quite acceptable.

The electrodes 702, 703 are then fabricated so as to have a suitable shape and suitably large surface area as described above from a metal or other material which is a good electrical conductor, for example, copper sheet material. The electrodes 702, 703 may be fabricated from a thin layer of highly conductive metal leaf applied to a base plate formed from an insulating material. Other examples include grid electrode material, mesh electrode material, or braided electrode material. Furthermore, suitably conductive non-metallic materials may be applied as well.

Figure 11:
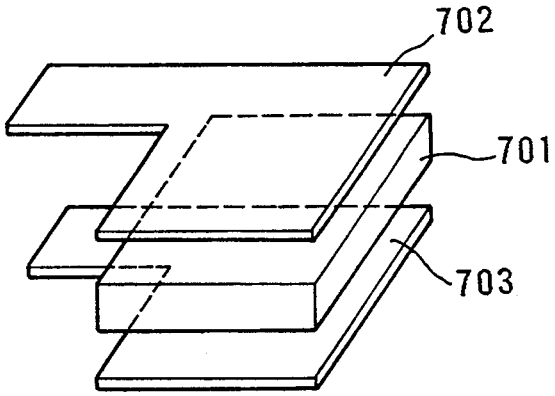
FIG. 11 is an oblique view showing a manufacturing method according to a seventh embodiment of the present invention.

After the block of PTC composition 701 and electrodes 702, 703 have been formed to the desired specifications, as shown in FIG. 11, the block of PTC composition 701 is sandwiched between the contact portions of the two electrodes 702, 703, and each of the two surfaces of the block of PTC composition 701 having the largest surface area are caused to adhere to a respective contact portion of each electrode 702, 703. To achieve this adhesion between the electrodes 702, 703 and the block of PTC composition 701, various types of chemical and physical means may be employed. For example, a pressure bonding technique may be used in which, after the opposing surfaces of the block of PTC composition 701 are brought in contact with the contact portions of their respective electrodes 702, 703, by applying a pressure of 1–100 kg/cm$^2$ against the block of PTC composition 701 by the contact surfaces of the electrodes 702, 703 at a temperature higher than the melting point of the PTC composition for a minute or longer, adhesion can be achieved. Further, a conductive adhesive agent, for example Dotite (Fujikura Chemical Co.), Silcoat (Fukuda Metal Foil and powder Co.) may be employed, applying the agent by methods such as spraying, coating with a brush, or using a roll coater. In the case where the PTC composition 701 is formed of a composite resin material, by maintaining the electrodes 702, 703 in a fixed position having a desired gap therebetween, injection molding methods are available in which the PTC composition 701 may be directly extruded between the electrodes 702, 703 thus forming the block of PTC composition 701 and achieving adhesion in one operation.

Eighth Preferred Embodiment

In the following section, a manufacturing method will be described according to an eighth preferred embodiment with reference to FIGS. 12 and 13, by which the PTC thermistors of the fourth preferred embodiment shown in FIGS. 4 and 5, as well as alternate embodiments thereto, can be fabricated. The PTC thermistors of the fourth preferred embodiment are formed so that the lead portions extend from different sides of the PTC thermistor.

Figure 12:
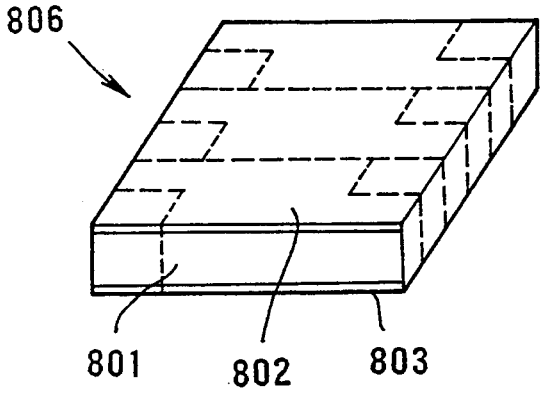
FIGS. 12 and 13 are oblique views showing steps of a manufacturing method-according to an eighth embodiment of the present invention.

As shown in FIG. 12, a thermistor sheet 806 is formed by sandwiching a sheet of PTC thermistor composition 801 between two sheets 802, 803. This thermistor sheet 806 may be fabricated using conventional methods as have been described earlier.

Figure 13:
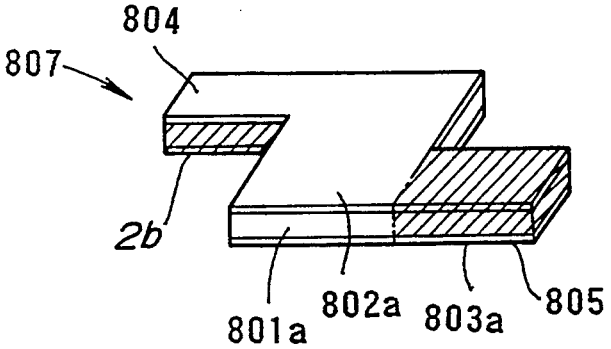

Next, the thermistor sheet 806 is cut along the broken lines shown in FIG. 12, using for example a jig saw, so as to form a plurality of PTC thermistor chips 807 having tongue-like projections protruding from opposite sides of the PTC thermistor chips 807, an example of which is shown in FIG. 13. Additionally, a laser, rotary saw, band saw, stamping, etc., or other suitable means may be used for the cutting operation. Neither the shape, nor the orientation of the tongue-like projections of the fabricated PTC thermistor chips 807 are limited to those as shown in FIG. 13. The tongue-like projections can thus be broader or thinner as desired, and can protrude from adjacent sides of the PTC thermistor chip 807 if preferable.

Next, by a partial thickness cutting operation, the portions of the PTC thermistor chip 807 shaded with diagonal lines in FIG. 13 are mechanically removed by cutting through one of the electrode plates and the adjacent PTC composition, for example by using a grinder, to remove the adherent PTC composition, thus removing the portions of the plates that lie within each of the two shaded portions, as well as the PTC composition 801 from both of the shaded sections. For the above partial thickness cutting, a sharp blade or a grinder may be used, or cutting to a controlled depth with a rotary saw or laser is also applicable. In this way, the block of PTC composition 801*a* is formed, as well as the lead portion 804 which is formed on one side of the PTC thermistor chip 807 as an extension of the contact portion 802*a* formed from sheet 802, and the other lead portion 805 which is formed on the opposite side of the PTC thermistor chip 807 from an extension of the contact portion 803*a* formed from the other sheet 803 located on the opposite surface of the PTC thermistor chip 807. The PTC thermistor manufactured in this way is identical to the PTC thermistor S4*b* shown in FIG. 5.

Ninth Preferred Embodiment

In the following section, a manufacturing method will be described according to an ninth preferred embodiment which is exemplary of the method, with reference to FIGS. 14, 15 and 16.

Figure 14:
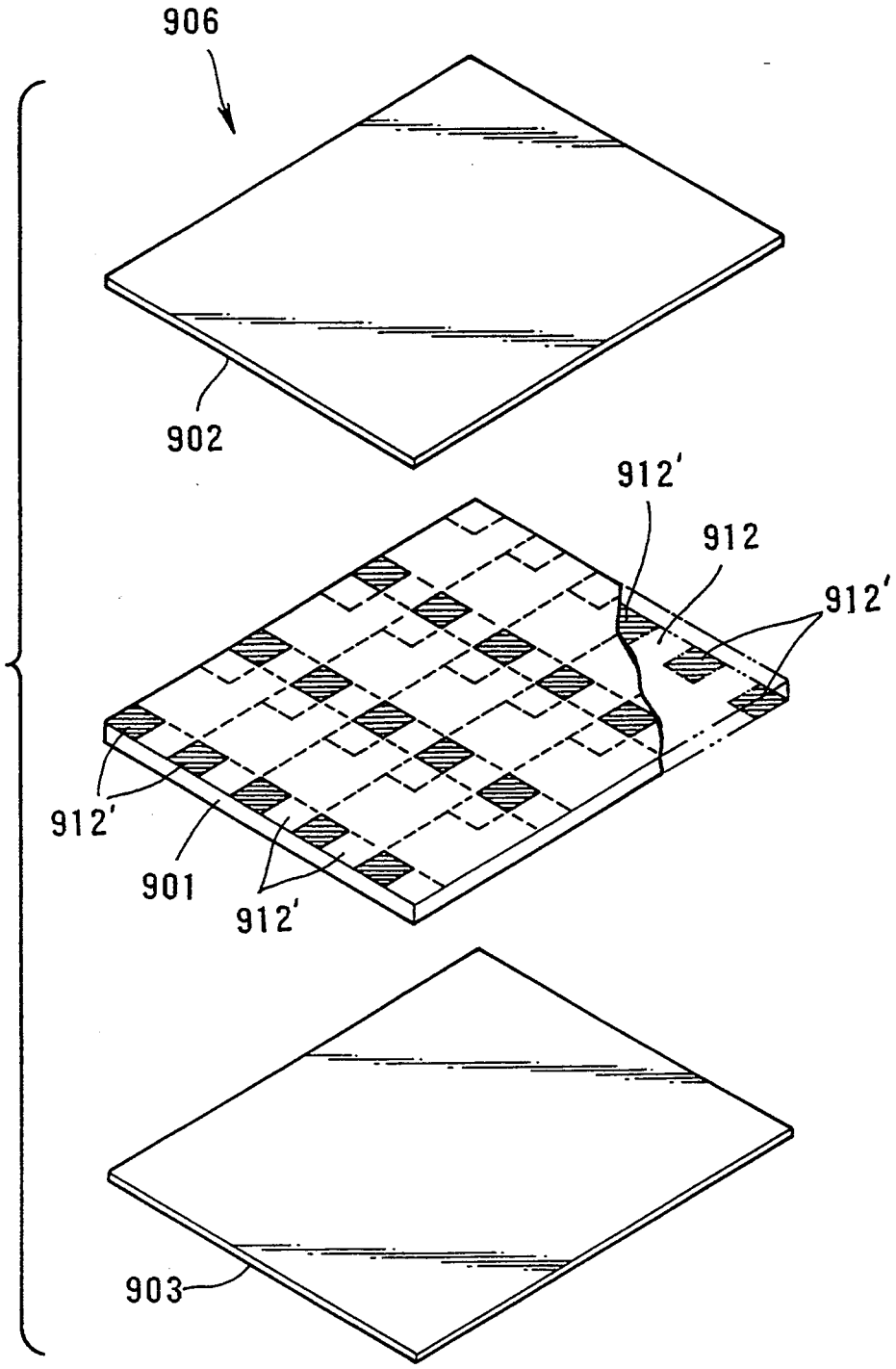
FIGS. 14 through 16 are oblique views showing steps of a manufacturing method according to a ninth embodiment of the present invention.

As shown in FIG. 14, a thermistor sheet 906 is prepared by first forming a plurality of nonadhesive regions 912 on each surface of a sheet of PTC thermistor composition 901 using an appropriate pattern for the side to which it is applied, after which the sheet of PTC thermistor composition 901 thus prepared is sandwiched between two metallic sheets 902, 903 which become adherent to the portions of the respective sides of the sheet of PTC thermistor composition 901 which have not been treated so as to be nonadhesive. Additionally or alternatively, the nonadhesive regions 912 may be formed on the appropriate sides of the electrode plates rather than on the PTC thermistor composition.

The method for creating the above described nonadhesive regions 912 is not particularly limited provided that the appropriate areas are made sufficiently nonadherent. One applicable method, for example, is to selectively mask those areas which are desired to be adhesive using suitable patterns and then apply a non-stick paint, for example Relco Ace (Dow Corning Toray Silicon Co.), or Daifree (Daikin Industrial Ltd. ), over the masked and unmasked regions using a roller, roll coater or brush or by spraying, after which the masks are removed. Another method is to apply a suitably cut-out thin film or tape to each surface of the sheet of PTC thermistor composition 901 or to the surfaces of the electrode plates, the thin film or tape formed of, for example, polytetrafluoroethylene (available commercially as Teflon), Teflon coated paper, silicon coated paper or some other material with similar non-stick properties. When polytetrafluoroethylene film or tape is used, a thickness of less than 0.5 mm, or more preferably, less than 0.1 mm is desirable.

Figure 15:
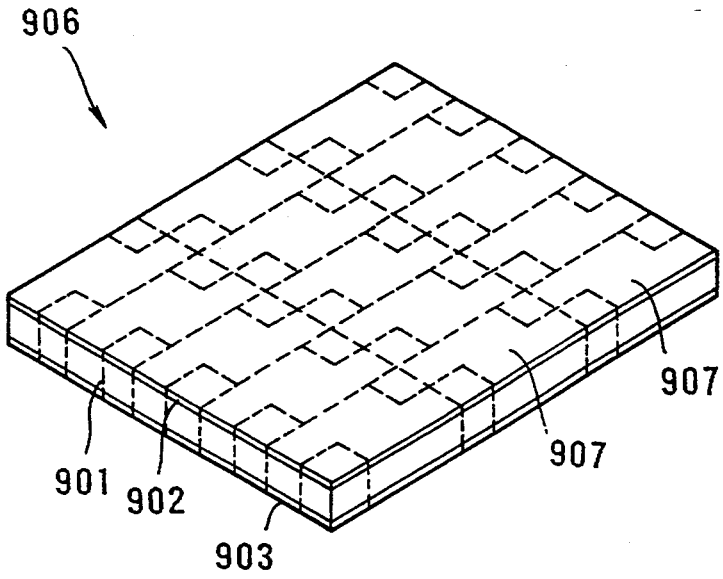
Figure 16:
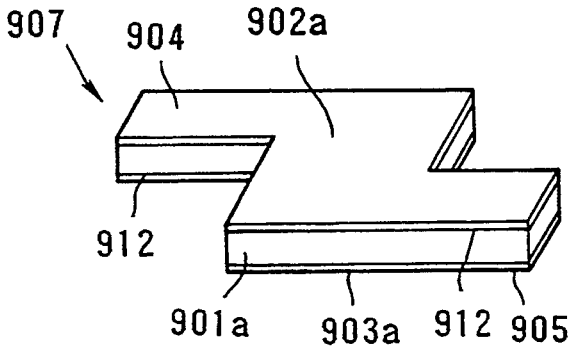

Next, the thermistor sheet 906 thus fabricated is cut along the broken lines shown in FIG. 15, just as in the eighth embodiment, so as to form a plurality of PTC thermistor chips 907 having tongue-like projections protruding from opposite sides of the PTC thermistor chips 907, an example of which is shown in FIG. 16. For every tongue-like projection, one side corresponds to one of the nonadhesive regions 912 previously laid down on the sheet of PTC thermistor composition 901. Additionally, based on the patterns according to which the nonadhesive regions 912 were laid down on the sheet of PTC thermistor composition 901 for each PTC thermistor chip 907, the nonadhesive regions for the two tongue-like projections lie on opposite sides of the PTC thermistor chip 907 with respect to one another. As can be seen from FIG. 16, with the exception of the nonadhesive regions 912, the PTC thermistor chip 907 is identical to the PTC thermistor chip 807 produced by the manufacturing method of the eighth preferred embodiment as shown in FIG. 13.

Next, the portions of the PTC thermistor composition 901 as well as the portion of one of the metallic sheets 902, 903 which is adherent thereto is selectively removed from each tongue-like projection of each PTC thermistor chip 907. The portions of the tongue-like projections to be eliminated can easily be removed by cutting through the full thickness of the tongue-like projection up to but not including the portion of the sheet 902, 903 which is to remain, using for example a laser. After this is accomplished, the portions to be removed easily fall away and can be separating from the manufactured PTC chips by shaking over a grid with a suitable mesh size.

Thus, for each tongue-like projection, only the portion of one of the metallic sheets 902, 903 which was overlying the nonadhesive region 912 lying on one side of the tongue-like projection remains. These remaining portions of the metallic sheets 902, 903 lying in the tongue-like projections thus correspond to the lead portions 904, 905, while the rest of the remaining portions of the sheets 902, 903 overlying both sides of the main body of the PTC thermistor chip 907 corresponds to the contact portions 902*a*, 903*a*. The PTC thermistor thus fabricated is identical to the PTC thermistor S4*b* of the fourth embodiment shown in FIG. 5.

In the manufacturing method of the present embodiment as described thus far, the nonadhesive regions 912 are laid over both surfaces of the sheet of PTC thermistor composition 901 in blocks surrounded by adhesive regions 912', and furthermore, the cutout pattern of the individual PTC thermistor chips 907 from the sheet of PTC thermistor composition 901 is such that the tongue-like projections of adjacent chips do not interlock at all. The present invention is not so limited, however, and other arrangements are possible whereby waste of the PTC composition is minimized. For example, in distinction to the patterns shown in FIGS. 15 and 16, another possible arrangement would be to provide a cutout pattern for the individual PTC thermistor chips 907 from the sheet of PTC thermistor composition 901 such that the PTC thermistor chips 907 are arranged in parallel rows with the tongue-like projections of adjacent rows interlocking. Thus, the width of each tongue-like projection is one half the width of the edge of the PTC thermistor chip 907 from which it projects. With such an arrangement, the nonadhesive regions 912 are laid over both surfaces of the sheet of PTC thermistor composition in the form of equidistantly placed strips extending the width of the sheet of PTC thermistor composition 901 parallel to the rows of chips, overlying the interlocking tongue-like projections, and alternating from side to side of the sheet of PTC thermistor composition 901 with each successive strip. In this way, at the expense of a slightly more complicated cutting process, not only is waste of the PTC composition minimized, but additionally, application of the nonadhesive regions 912 in strips can be carried out much more efficiently than as isolated blocks spread over the surfaces.

Furthermore, neither the shape, nor the orientation of the tongue-like projections of the fabricated PTC thermistor chips 907 are limited to those as shown in FIG. 16. The tongue-like projections can thus be broader or thinner as desired, and can protrude from adjacent sides of the PTC thermistor chip 907 if preferred by employing different cutout patterns and different patterns for applying the non-adhesive regions. Additionally, for certain design requirements, it may be possible to apply the non-adhesive regions to only one surface of the PTC composition.

For the various PTC thermistors according to the first through seventh embodiments and for those manufactured by the manufacturing methods of the eighth and ninth embodiments, the resistance properties of the respective PTC thermistors can be finely adjusted to meet design requirements. Thus for example, by varying the total volume of the block of PTC composition, or the total surface area of the PTC composition that is in contact with the electrode plates in the manufactured PTC thermistor, it is possible to vary the resistance and other electrical properties of the manufactured PTC thermistor. Accordingly, by adjusting the amount of the plates and PTC composition that is removed when the leads are formed, for example, the resistance properties of the resulting PTC thermistor can quite easily be controlled. Additionally, fine tuning of the resistance properties is possible by continuously or intermittently measuring the resistance of the PTC thermistor while trimming or cutting away electrode plate material or PTC composition during manufacture.

In the case of the PTC thermistors of the sixth preferred embodiment as shown in FIGS. 7, 8 and 9, holes were provided in the leads for facilitating connection to other components. It is perfectly acceptable to include an operation for drilling, chemically etching or otherwise forming this kind of hole as is known in the art in the manufacturing methods of the eighth and ninth embodiments.

While the PTC thermistors and the manufacturing methods therefor described herein have generally concerned PTC thermistors having two lead portions, it should be understood that it is not the intent of the inventors to exclude PTC thermistors having other than two lead portions. For example, for certain surface mounted applications, it could be feasible to employ a PTC thermistor having only one lead portion.

Although the particular embodiments of the invention discussed herein illustrate the lead portion of the electrode as being coplanar with the contact portion, it will be understood that according to the present invention, the lead portion need not be coplanar with the contact portion. The lead portion, so long as it is integrally formed with the contact portion, can be formed in a non-coplanar (e.g., bent) relationship with the contact portion. Alternately, the lead portion, if originally integrally formed coplanar with the contact portion, also can be altered from a coplanar relationship with the contact portion, whether such alteration is accomplished before or after the electrode is joined to the PTC composition.

While applicant has described the present invention in what the applicant considers the most practical, preferred embodiments, applicant does not limit the present invention to the disclosed embodiments, but, on the contrary, intends the invention to cover various modifications and equivalent arrangements included within the spirit and scope of the appended claims.

What is claimed is:

1. A manufacturing method for PTC thermistors including:

(a) preparing a substantially flat sheet of PTC composition demonstrating a positive temperature coefficient behavior and having two contact surfaces;

(b) preparing a pair of electrode plates each having a contact surface, each said contact surface having a plurality of lead portions and non-lead portions;

(c) sandwiching said sheet of PTC composition between said contact surfaces of said pair of electrode plates so that at least a plurality of portions of each said contact surface of said sheet of PTC composition comes to be bonded to corresponding portions of said contact surfaces of said pair of electrode plates thereby forming a PCT thermistor plate;

(d) cutting said PCT thermistor plate into a plurality of PCT thermistor chips, each of said PCT thermistor chips having non-lead sections which include a corresponding non-lead portion from each of said electrode plates and each of said PCT thermistor chips having at least one lead section which includes a corresponding lead portion from at least one of said electrode plates; and (e) removing the PTC composition and the overlying portion of one of the plates from said at least one lead section, leaving the overlying portion of the other of the plates thereby forming at least one electrical lead.

2. A manufacturing method for PTC thermistors in accordance with claim 1 compromising a further step of:

(f) while continuously measuring the electrical resistance between the non-lead portion of each of said electrode plates of a PCT thermistor chip, trimming and removing a portion of at least one of the electrode plates and the PTC composition, thereby manufacturing a PTC thermistor having a desired electrical resistance value.

3. A manufacturing method for PTC thermistors in accordance with claim 1 above whereby the cutting of the PCT thermistor plate is carried out so as to form at least two lead sections on each of a plurality of said PTC thermistor chips, and whereby the overlying portion of one of the electrode plates is removed from a first of the lead sections of each of said plurality of PTC thermistor chips and the overlying portion of the other electrode plate is removed from a second lead section of said plurality of PTC thermistor chips.

4. A manufacturing method for PTC thermistors in accordance with claim 1 or 3 wherein during said step of sandwiching said sheet of PTC composition between said contact surfaces of said pair of electrode plates, a nonadhering agent is caused to intervene between the contact surface of at least one electrode plate and she corresponding contact surface of the sheen of PTC composition in a plurality of locations so that at said plurality of locations, the contact surfaces of said at lease one electrode plate do not become bonded to the contact surfaces of the sheet of PTC composition, thereby facilitating the removal of portions of the PTC composition from the lead sections.

5. A manufacturing method for PTC thermistors in accordance with claim 1 or 3 wherein during said step of sandwiching said sheet of PTC composition between said contact surfaces of said pair of electrode planes, a nonadhering agent is caused to intervene between the contact surface of both electrode plates and the corresponding contact surfaces of the sheet of PTC composition in a plurality of locations so that at said plurality of locations, the contact surfaces of said electrode plates do not become bonded to the corresponding contact surfaces of the sheet of PTC composition, thereby facilitating the removal of portions of the PTC composition from the lead sections.

6. A manufacturing method for PTC thermistors in accordance with claim 1 or 3 during wherein said step of sandwiching said sheet of PTC composition between said contact surfaces of said pair of electrode plates, a nonadhering agent is caused to intervene between the contact surface of at least one electrode plate and the corresponding contact surface of the sheet of PTC composition in a plurality of locations so that an said plurality of locations, the contact surfaces of said electrode plates become bonded to a lesser degree to the corresponding contact surfaces of the sheet of PTC composition, thereby facilitating the removal of portions of the PTC composition from the lead sections.

7. A manufacturing method for PTC thermistors in accordance with claim 1 or 3 wherein during said step of sandwiching said sheet of PTC composition between said contact surfaces of said pair of electrode plates, a nonadhering agent is caused to intervene between the contact surface of both electrode plates and the corresponding contact surfaces of the sheet of PTC composition in a plurality of locations so that at said plurality of locations, the contact surfaces of said electrode plates become bonded to a lesser degree to the corresponding contact surfaces of the sheet of PTC composition, thereby facilitating the removal of portions of the PTC composition from the lead sections.

8. A manufacturing method for PTC thermistors in accordance with claim 1 or 3 wherein during said third step of sandwiching said sheet of PTC composition between said contact surfaces of said pair of metal electrode plates, polytetrafluoroethylene (Teflon) is caused to intervene between the contact surface of at least one metal plate and the corresponding contact surface of the sheet of PTC composition in a plurality of locations so that at said plurality of locations, the contact surface of said electrode plates do not become bonded to the corresponding contact surfaces of the sheet of PTC composition, whereby portions of PTC composition in the lead portions may be more easily removed.

9. A manufacturing method for PTC thermistors in accordance with either claim 1 or 3 wherein at least one lead portion of at least one of said sections is formed so as to include at lease one hole.

10. A manufacturing method for PTC thermistors in accordance with claim 1 wherein said electrode plates are formed of a metallic material.

* * * * *